US006245473B1

(12) United States Patent
Anayama et al.

(10) Patent No.: US 6,245,473 B1
(45) **Date of Patent: *Jun. 12, 2001**

(54) ELECTROPHOTOGRAPHIC APPARATUS WITH DC CONTACT CHARGING AND PHOTOSENSITIVE LAYER WITH POLYCARBONATE RESIN IN CHARGE GENERATION LAYER

(75) Inventors: Hideki Anayama, Yokohama; Toshiyuki Yoshihara, Kawasaki; Itaru Yamazaki, Yokohama; Hideyuki Ainoya; Hidetoshi Hirano, both of Tokyo; Mayumi Kimura, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/734,174

(22) Filed: Oct. 21, 1996

Related U.S. Application Data

(62) Division of application No. 08/281,626, filed on Jul. 28, 1994, now abandoned.

(30) Foreign Application Priority Data

Jul. 30, 1993 (JP) ..... 5-206895

(51) Int. Cl.[7] ..... G03G 5/00
(52) U.S. Cl. ..... 430/96; 399/159; 399/176
(58) Field of Search ..... 430/58, 902, 96; 355/246; 399/159, 176

(56) References Cited

U.S. PATENT DOCUMENTS

| | | | | |
|---|---|---|---|---|
| 4,464,450 | * | 8/1984 | Teuscher et al. | 430/59 |
| 4,855,202 | | 8/1989 | Yoshihara et al. | 430/58 |
| 4,908,288 | | 3/1990 | Anayama | 430/58 |
| 4,933,246 | * | 6/1990 | Teuscher | 430/64 |
| 4,974,026 | * | 11/1990 | Maruyama | 355/221 |
| 5,268,250 | * | 12/1993 | Matsuo et al. | 430/128 |
| 5,270,143 | * | 12/1993 | Tomiyama et al. | 430/109 |
| 5,319,424 | * | 6/1994 | Tomiyama et al. | 430/109 |
| 5,378,566 | * | 1/1995 | Yu | 430/58 |
| 5,485,248 | * | 1/1996 | Yano et al. | 399/168 |

FOREIGN PATENT DOCUMENTS

| | | |
|---|---|---|
| 56-104351 | 8/1981 | (JP) . |
| 57-178267 | 11/1982 | (JP) . |
| 58-40566 | 3/1983 | (JP) . |
| 58-139156 | 8/1983 | (JP) . |
| 58-150975 | 9/1983 | (JP) . |
| 63-149668 | 6/1988 | (JP) . |

* cited by examiner

*Primary Examiner*—Laura Weiner
(74) *Attorney, Agent, or Firm*—Fitzpatrick, Cella, Harper & Scinto

(57) ABSTRACT

An electrophotographic photosensitive member comprises a conductive support and a photosensitive layer which comprises a charge generation layer and a charge transport layer, characterized in that the charge generation layer contains a polycarbonate resin, and the electrophotographic photosensitive member is electrostatically charged by applying a direct current voltage to a charging member in contact with the surface of said electrophotographic photosensitive member.

3 Claims, 2 Drawing Sheets

ELECTROPHOTOGRAPHIC APPARATUS WITH DC CONTACT CHARGING AND PHOTOSENSITIVE LAYER WITH POLYCARBONATE RESIN IN CHARGE GENERATION LAYER

This application is a continuation of application Ser. No. 08/281,626, filed Jul. 28, 1994, now abandoned.

BACKGROUND OF THE INVENTION

1. Field of the Invention

This invention relates to an electrophotographic photosensitive member, and more particularly to an electrophotographic photosensitive member comprising a specific resin to be electrostatically charged directly by a charging means. This invention also relates to a process cartridge and an electrophotographic apparatus, each having such an electrophotographic photosensitive member.

2. Related Background Art

When images are formed on an electrophotographic photosensitive member in electrophotography basically comprising the steps of charging, exposure, developing, transfer, fixing and cleaning, usually the charging has been carried out by so-called corona charging, where the photosensitive member is electrostatically charged with corona discharge by applying a high voltage (DC 5 to 8 kV) to a metal wire. This method, however, involves problems due to by-products of corona discharge, such as ozone and $NO_x$. They adhere to the surface of the photosensitive member or change the properties of the photosensitive member to cause smeared images and blurred images, and soil the wire so as to cause blank areas and black lines in images. In particular, photosensitive members, the photosensitive layer of which contains an organic photoconductive material, have a lower chemical stability than those making use of other inorganic photoconductive material such as selenium or amorphous silicon. Therefore, upon the exposure to the by-products of corona discharge, chemical reactions (mainly oxidation) are liable to occur, to thereby to cause deterioration of the photosensitive member.

Another problem of corona charging is its poor electric power efficiency for a charging means, since only 5 to 30% of electric current is directed to the photosensitive member, and the rest flows into a shielding plate.

As measures for solving such problems, Japanese Patent Application Laid-open Nos. 57-178267, 56-104351, 58-40566, 58-139156, 58-150975 and so forth disclose so-called direct discharging, in which a voltage is applied to a charging member in contact with the surface of a photosensitive member to electrostatically charge the photosensitive member not using a corona discharger. Particularly, this is a method in which a charging member such as a conductive elastic roller is brought into contact with the surface of a photosensitive member and a DC voltage of about 1 to 2 kV is externally applied to this charging member to electrostatically charge the surface of the photosensitive member to have a given potential.

Such direct charging, however, has a problem that the charging often becomes uneven. The uneven charging means the entire surface of the photosensitive member is not evenly charged, with defectively charged areas such as spots, or longitutional lines of about 2 to 200 mm long and about at least 0.5 mm wide. This results in image defects such as white dots or white lines (phenomena in which white spots or lines appear in black solid images) in normal development, and black dots or black lines (phenomena in which black spots or lines appear in white solid images) in reversal development.

Accordingly, in order to improve the uniformity of charging, a method is proposed in which a pulsating current voltage comprised of a direct current voltage ($V_{DC}$) superimposed with an alternating current voltage ($V_{AC}$) is applied to a charging member (Japanese Patent Application Laid-open No. 63-149668). In this case, in order to prevent image defects such as white dots and white lines or black dots and black lines by maintaining the uniformity of charging, the superimposed AC voltage must have a peak-to-peak potential difference ($V_{P-P}$) at least twice the DC voltage.

However, when the AC voltage is increased to prevent image defects, the maximum applied voltage of the pulsating current voltage also increases. Thus, discharge insulation breakdown will occur even at places having very slight defects inside the photosensitive member. In particular, in the case of photosensitive members making use of an organic photoconductive material of a low withstand voltage strength, the insulation breakdown is very liable to occur. In such an instance, in the normal development, blank images may appear in the lengthwise direction of contact areas and, in the reversal development, black strips.

Superimpose of $V_{AC}$ means that a high-frequency current is applied to a charging member which has been brought into contact with an electrophotographic photosensitive member. Hence noise may be generated at the time of charging. Further, since currents of the AC-component flow into the electrophotographic photosensitive member in excess, electrical deterioration such as an increase of residual potential often occurs, or the surface of the photosensitive member is often damaged in part where the toner adheres to cause so-called melt-adhesion.

Under such circumstances, a system to apply only $V_{DC}$ without superimposing $V_{AC}$ has been revaluated. There, however, still remains the problem of the nonuniformity of charging, as previously discussed.

Recently, as the image quality is improved, there has become a problem of so-called transfer memory, a phenomenon in which the capacitance inside the photosensitive member changes as a result of transfer charging, causing a difference in sensitivity between the area subjected to transfer charging and the area not subjected to transfer charging.

SUMMARY OF THE INVENTION

An object of the present invention is to provide an electrophotographic photosensitive member which does not cause uneven charges in the areas such as spots or lines and causes less potential variations.

Another object of the present invention is to provide an electrophotographic photosensitive member that carries less transfer memory.

Still another object of the present invention is to provide a process cartridge and an electrophotographic apparatus, having such an electrophotographic photosensitive member and a charging means.

The present invention provides an electrophotographic photosensitive member comprising a conductive support and a photosensitive layer formed on the conductive support; said photosensitive layer comprising a charge generation layer and a charge transport layer, and said charge generation layer containing a polycarbonate resin;

said electrophotographic photosensitive member being electrostatically charged by applying a direct current voltage to a charging member coming into contact with the surface of said electrophotographic photosensitive member.

The present invention also provides a process cartridge and an electrophotographic apparatus, having the electrophotographic photosensitive member as described above and a charging means.

DETAILED DESCRIPTION OF THE PREFERRED EMBODIMENTS

The electrophotographic photosensitive member according to the present invention has a charge generation layer containing a polycarbonate resin, and is electrostatically charged by applying a DC voltage to a charging member coming into contact with the surface of the photosensitive member.

Figure 1:
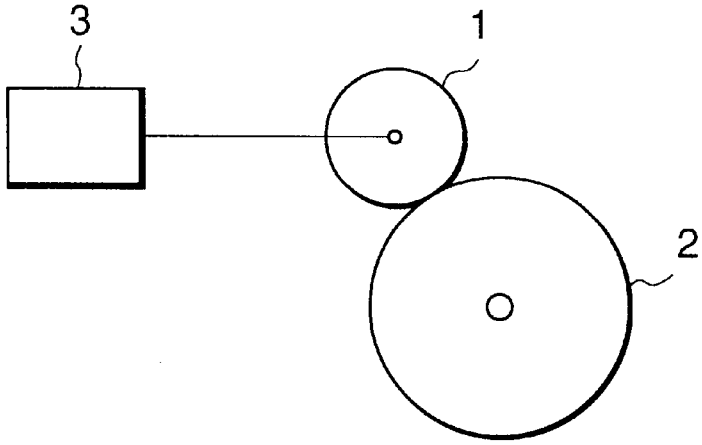
FIG. 1 illustrates an example of the disposition of the electrophotographic photosensitive member of the present invention and a charging means.

FIG. 1 illustrates an example of the disposition of the electrophotographic photosensitive member of the present invention and a charging means. As shown in FIG. 1, a charging member 1 comes into contact with an electrophotographic photosensitive member 2, and electrostatically charges the photosensitive member 2 by applying a DC voltage from an external power source 3 connected thereto.

The charging member 1 used in the present invention may be any of the known charging members, including those having the form of a roller as shown in FIG. 1, as well as a blade, a brush or a belt. When the charging member is a roller or a blade, it can be formed by molding, coating, and drying, a resin having a conductivity or a resin having been made conductive by, e.g., dispersing carbon black, metal powder, metal oxide or the like, around a conductive mandrel made of a metal or alloy. When the charging member is a brush, it is exemplified by a magnetic brush making use of magnetic particles and a fur brush comprised of a brush made of the above conductive resin or the resin made conductive.

Figure 2:
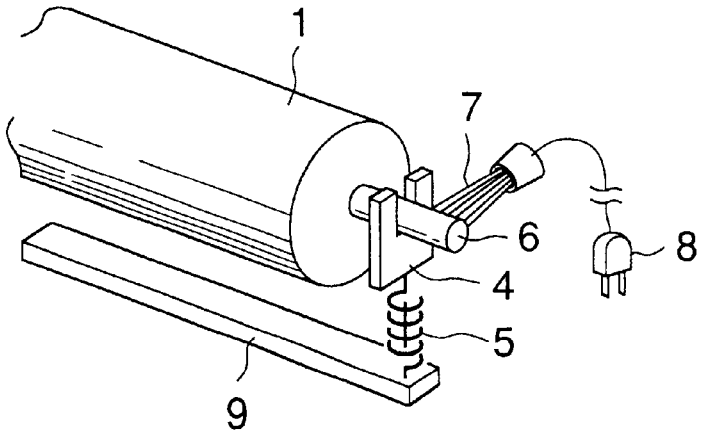
FIG. 2 illustrates an example of a charging unit for bringing a charging member into pressure contact with the electrophotographic photosensitive member.

FIG. 2 illustrates a specific example of a charging unit for bringing the charging member into pressure contact with the electrophotographic photosensitive member. The roller type charging member 1 is so designed that it can be brought into pressure contact with the photosensitive member by the action of a spring 5 via a fulcrum 4. To a mandrel 6 positioned at the center of the charging member 1, a voltage is applied from a power supply brush 7. Reference numeral 8 denotes a connector for receiving power from the main body; and 9, a support for supporting the charging member 1 so as to be fitted to the main body along a guide rail provided on the main body.

Figure 3:
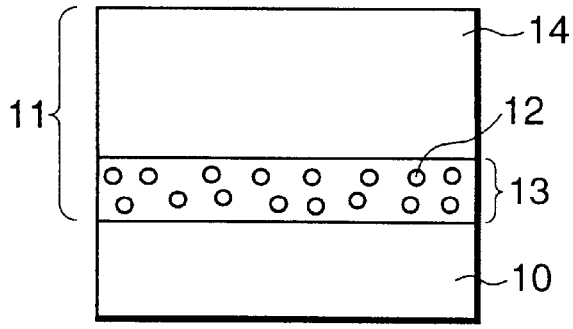
FIG. 3 illustrates an example of the constitution of the electrophotographic photosensitive member according to the present invention.

FIG. 3 illustrates an example of the constitution of the electrophotographic photosensitive member according to the present invention. As shown in FIG. 3, a photosensitive layer 11 is provided on a conductive support 10. This photosensitive layer 11 comprises a charge generation layer 13 containing a charge-generating material 12 dispersed in a binder resin, and a charge transport layer 14 containing a charge-transporting material (not shown). In the present invention, the charge transport layer 14 may be either laminated on or beneath the charge generation layer 13. In view of mechanical durability, it may preferably be laminated on the charge generation layer.

The charge-generating material used in the present invention may include pyrylium dyes, thiopyrylium dyes, phthalocyanine pigments, anthanthrone pigments, dibenzopyrenequinone pigments, pyrathrone pigments, azo pigments, indigo pigments, quinacridone pigments and quinocyanine dyes. The charge generation layer 13 can be formed by coating with a dispersion prepared by well dispersing the above charge-generating material in 0.5 to 4-fold amount of polycarbonate together with a solvent by means of a homogenizer, ultrasonic waves, a ball mill, a vibrating ball mill, a sand mill, an attritor or a roll mill, followed by drying. It may preferably be in a layer thickness of 5 $\mu$m or less, and particularly preferably from 0.01 to 1 $\mu$m.

Preferred examples of the polycarbonate resin used in the present invention are shown below. Examples are by no means limited to these. In the following, n and m each represent a degree of polymerization (molar ratio).

(1)

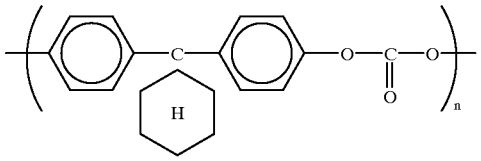

(2)

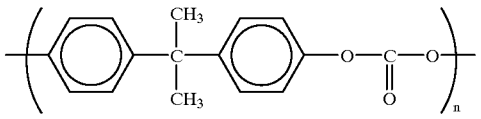

(3)

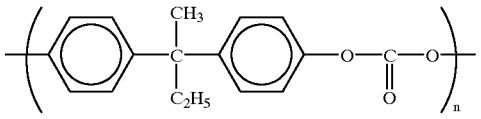

-continued (4)

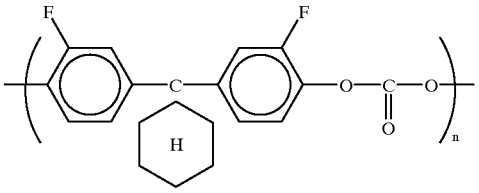

(5)

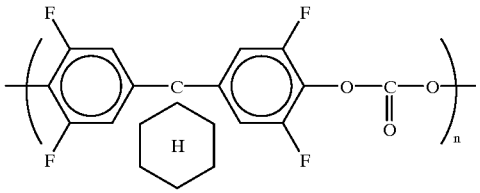

(6)

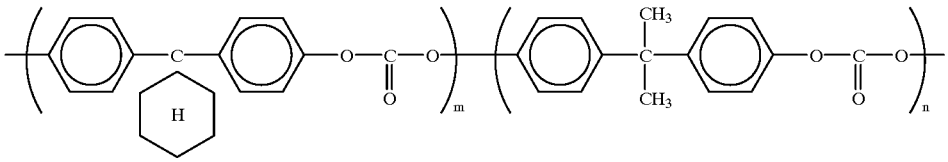

The polycarbonate resin used in the present invention may preferably have a weight average molecular weight of from 10,000 to 1,000,000, and particularly preferably from 20,000 to 500,000.

The charge-transporting material used in the present invention may include hydrazone compounds, pyrazoline compounds, styryl compounds, oxazole compounds, thiazole compounds, triarylmethane compounds and polyarylalkane compounds.

The charge transport layer 14 is commonly formed by coating with a solution prepared by dissolving the above charge-transporting material and a binder resin in a solvent, followed by drying. The charge-transporting material and the binder resin may be mixed in a proportion of from 2:1 to 1:2 in approximation. The charge transport layer may preferably be in a layer thickness of from 5 to 30 $\mu$m, and particularly preferably from 10 to 25 $\mu$m.

The binder resin used to form the charge transport layer 14 may include acrylic resins, styrene resins, polyesters, polycarbonate resins, polyacrylates, polysulfone, polyphenylene oxide, epoxy resins, polyurethane resins, alkyd resins and unsaturated resins. In the present invention, resins having the same monomer units as the polycarbonate resin used in the charge generation layer are particularly preferred. The binder resin may preferably have a weight average molecular weight of from 10,000 to 1,000,000, and particularly preferably from 15,000 to 100,000.

To the charge transport layer, an antioxidant, an ultraviolet absorbent, a plasticizer or a known charge-transporting material may be optionally added.

The conductive support used in the present invention may include, for example, the following.

(1) Supports made of metals or alloys such as aluminum, aluminum alloys, stainless steel and copper.

(2) Non-conductive supports made of glass, resin or paper or conductive supports of the above (1) on which a metal or alloy such as aluminum, aluminum alloy, palladium, rhodium, gold or platinum has been deposited or laminated to form a thin film.

(3) Non-conductive supports made of glass, resin or paper or conductive supports of the above (1) or (2) on which a conductive material such as a conductive polymer, tin oxide or indium oxide has been deposited to form a layer or a solution prepared by dispersing any of these conductive materials in a suitable solvent has been applied and dried to form a layer.

The conductive support may have the form of a drum, a sheet or a belt, and may preferably have a most preferable form which is selected for the electrophotographic apparatus to be used.

In the present invention, a subbing layer having a barrier function and an adhesive function may be provided between the conductive support and the photosensitive layer. The subbing layer can be formed of a material including casein, polyvinyl alcohol, nitrocellulose, polyamides (nylon 6, nylon 66, nylon 610, copolymer nylons, alkoxymethylated nylons, etc.), polyurethane and aluminum oxide. The subbing layer may preferably be in a layer thickness of 5 $\mu$m or less, and particularly preferably from 0.1 to 3 $\mu$m.

In the present invention, in order to protect the photosensitive layer from external mechanical and chemical bad influences, the photosensitive layer may be provided thereon with a protective layer such as a resin layer or a resin layer containing conductive particles or a charge-transporting material.

When the respective layers described above are formed by coating, the coating may include dip coating, spray coating, spin coating, roller coating, Mayer bar coating and blade coating.

The electrophotographic photosensitive member of the present invention can be used not only in electrophotographic copying machines, but also in the wide fields to which electrophotography is applied, e.g., laser beam printers, CRT printers, LED printers, facsimile machines and electrophotographic lithography systems.

The electrophotographic apparatus of the present invention will be specifically described below.

Figure 4:
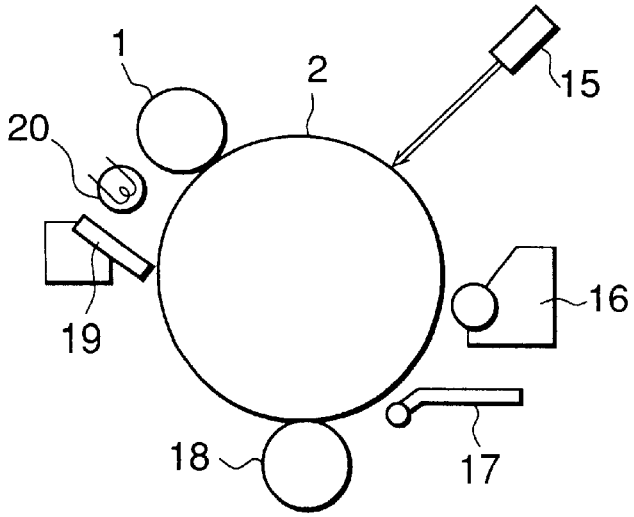
FIG. 4 illustrates an example of the constitution of the electrophotographic apparatus according to the present invention.

FIG. 4 illustrates an example of the constitution of the electrophotographic apparatus of the present invention. This apparatus comprises an electrophotographic photosensitive member 2 around which a roller type charging member 1, an imagewise exposure means 15, a developing means 16, a paper feed roller with a paper feed guide 17, a transfer charger 18, a cleaning means 19 and a pre-exposure means 20 are provided. Images are formed in the following way. First, a DC current is applied to the charging member 1 provided on the electrophotographic photosensitive member 2 in contact therewith, to electrostatically charge the surface of the photosensitive member 2, and the photosensitive member 2 is imagewise exposed with the exposure means 15 to form an electrostatic latent image corresponding to the original. Next, a toner is made to adhere to the photosensitive member 2 through the developing means 16 to develop (convert into a visible image) the electrostatic latent image formed on the photosensitive member 2. Then, the toner image thus formed on the photosensitive member 2 is transferred by means of the transfer charger 18 to a transfer medium such as paper fed through the paper feed roller and the paper feed guide 17. The residual toner, having not been transferred to the transfer medium, remaining on the photosensitive member 2 is collected with the cleaning means. When any residual charges remain inside the photosensitive member, the photosensitive member 2 should be irradiated with light from the pre-exposure means 20 to eliminate the residual charges. Meanwhile, the transfer medium on which the toner image has been formed is transported to a fixing assembly (not shown) through a transport means (not shown), where the toner image is fixed. In this electrophotographic apparatus, as a light source of the imagewise exposure means 15, a halogen lamp, a fluorescent lamp or a laser may be used. If necessary, other auxiliary process may also be added.

In the present invention, plural components selected from above photosensitive member 2, charging member 1, developing means 16 and cleaning means 19 may be joined as a process cartridge, so that the process cartridge can be freely mounted on or detached from the main body of the electrophotographic apparatus such as a copying machine or a laser beam printer. For example, at least one of the charging member 1, the developing means 16 and the cleaning means 19 may be held into one cartridge together with the photosensitive member so that the process cartridge can be freely mounted on or detached from the body using a guide means such as rails provided in the main body of the apparatus.

EXAMPLES

The present invention will be described below by giving Examples.

Example 1

On an aluminum cylinder of 30 mm diameter and 350 mm long, a 5% methanol solution of polyamide resin (trade name: AMILAN CM8000, available from Toray Industries, Inc.) was applied by dipping and dried to form a subbing layer of 0.3 $\mu$m thick.

Next, 10 parts (parts by weight; the same applies hereinafter) of a bisazo pigment represented by the formula:

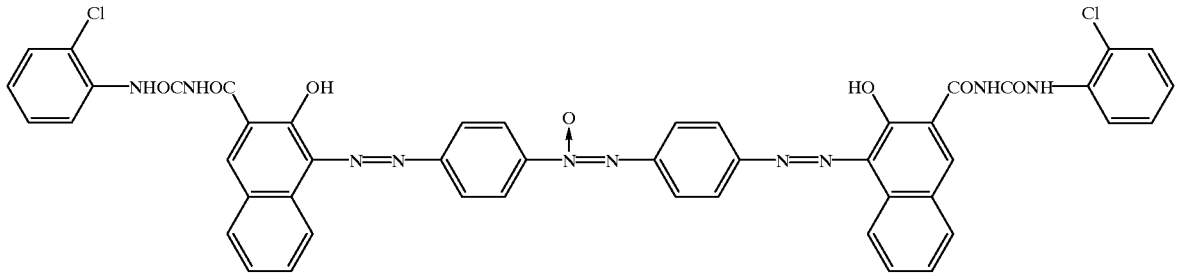

10 parts of polycarbonate resin (Exemplary Compound No. 1; weight average molecular weight: 28,000) and 60 parts of cyclohexanone were dispersed for 20 hours in a sand mill grinder making use of glass beads of 1 mm diameter. To the resulting dispersion, 100 parts of methyl ethyl ketone was added to obtain a coating solution. This was applied on the above subbing layer, followed by drying to form a charge generation layer. This layer was in a thickness of 0.12 $\mu$m.

Next, 7 parts of a triarylamine represented by the formula:

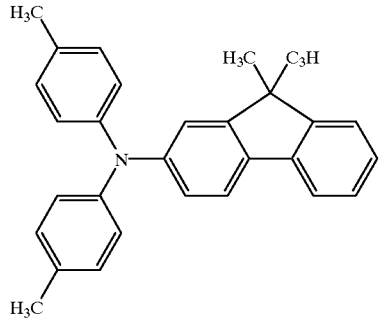

and 3 parts of a styryl compound represented by the formula:

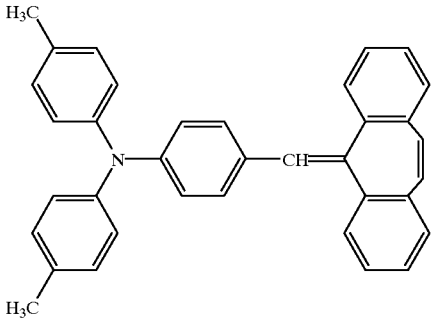

were dissolved in a mixture of 10 parts of polycarbonate resin (Exemplary Compound No. 1; weight average molecular weight: 28,000) and 60 parts of monochlorobenzene. The resulting solution was applied on the above charge generation layer and dried to form a charge transport layer. This layer was in a thickness of 25 μm after dried.

The electrophotographic photosensitive member thus obtained was installed in a copying machine NP-6030, manufactured by Canon Inc. First, a direct current of −700 V was applied from an external source to the charging roller, and a halftone original with a reflection density of 0.45 as measured by a Macbeth reflection densitometer was placed on the original stand to reproduce images. Images thus formed were visually inspected, and when 5 or more lines due to the nonuniformity of charging were observed in the image area corresponding to one round of the drum it was evaluated as "C"; an instance where 1 line to 4 lines appeared, as "B"; and an instance where no line appeared, as "A".

Then, in this state, the original was changed to a character pattern with a print percentage of about 3%), and images were continuously reproduced on 10,000 copy sheets, where the light area potential (hereinafter "$V_L$") was measured, and the change in $V_L$ at the initial stage and the end was indicated by:

$|V_L$ at the end$|-|V_L$ at the start$|$.

The amount of transfer memory is represented by an absolute value of the difference between $V_L$ when neither development nor transfer was carried out and $V_L$ when only development was not carried out.

Results obtained are shown in Table 2.

Examples 2 to 12

Example 1 was repeated to produce electrophotographic photosensitive members, except that the binder resin of the charge generation layer and the binder resin of the charge transport layer in Example 1 were changed as shown in Table 1. Evaluation was also made similarly.

Results obtained are shown in Table 2.

In Table 1, "Mw" indicates "weight average molecular weight".

TABLE 1

| Example | Exemplary Compound: Binder resin of charge generation layer | Binder resin of charge transport layer |
|---|---|---|
| 2 | No. 2; Mw: 30,000 | No. 1; Mw: 28,000 |
| 3 | No. 1; Mw: 80,000 | No. 1; Mw: 28,000 |
| 4 | No. 1; Mw: 47,000 | No. 1; Mw: 28,000 |
| 5 | No. 4; Mw: 28,000 | No. 1; Mw: 28,000 |
| 6 | No. 6; Mw: 42,000 (m = 0.7; n = 0.3) | Mo. 1; Mw: 28,000 |
| 7 | No. 2; Mw: 30,000 | No. 2; Mw: 30,000 |
| 8 | No. 1; Mw: 47,000 | No. 1; Mw: 47,000 |
| 9 | No. 4; Mw: 28,000 | No. 4; Mw: 28,000 |
| 10 | No. 6; Mw: 42,000 (m = 0.7; n = 0.3) | No. 6; Mw: 42,000 (m = 0.7; n = 0.3) |
| 11 | No. 1; Mw: 28,000 | Polystyrene; Mw: 42,000 |
| 12 | No. 1; Mw: 28,000 | Polymethyl methacrylate; Mw: 38,000 |

Examples 13 to 15

Electrophotographic photosensitive members were produced in the same manner as in Examples 1 to 3, respectively, except that the azo pigment used therein was replaced with oxytitanium phthalocyanine having strong peaks of diffraction angles of 2θ±0.2° at 9.0°, 14.2°, 23.9° and 27.1° in CuKα characteristic X-ray diffraction analysis. Evaluation was also made similarly, provided that Laser Jet III-Si (manufactured by Hewlett Packard Co.) was used as the electrophotographic apparatus, an original composed of alternately arranged black and white dots was used as the halftone original and an original composed of alternately arranged one-dot black and 100-dot horizontal line white was used as the original for continuous image reproduction.

Results obtained are shown in Table 2.

Example 16

On an aluminum cylinder, a subbing layer, a charge transport layer and a charge generation layer were formed in this order in the same manner as in Example 1 except that the charge generation layer and the charge transport layer were laminated in a reverse order and also that the charge generation layer was formed in a layer thickness of 0.5 μm.

Then, a solution prepared by mixing 25 parts of a curable acrylic monomer represented by the formula:

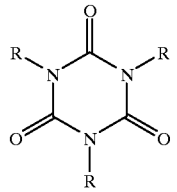

2.0 parts of 2-methylthioxanthone and 300 parts of toluene was applied by spray-coating on the above charge generation layer, followed by drying and then irradiation with ultraviolet rays for 20 seconds at a light intensity of 800 mW/cm$^2$ to form a protective layer. The layer thickness was 2.0 μm.

On the electrophotographic photosensitive member thus obtained, evaluation was made in the same manner as in Example 1 except that the charge polarity was set positive.

Results obtained are shown in Table 2.

Comparative Examples 1 to 4

Example 1 was repeated to produce electrophotographic photosensitive members, except that the polycarbonate resin, the binder resin, of the charge generation layer in Example 1 was replaced with polyvinyl butyral (weight average molecular weight: 100,000; degree of butyralation: 65%), polymethyl methacrylate (weight average molecular weight: 47,000), phenoxy resin (weight average molecular weight: 30,000) and cellulose resin (weight average molecular weight: 60,000), respectively. Evaluation was also made similarly.

Results obtained are shown in Table 2.

Comparative Example 5

Example 13 was repeated to produce an electrophotographic photosensitive member, except that the binder resin of the charge generation layer in Example 13 was replaced with that of Comparative Example 1. Evaluation was also made similarly.

Results obtained are shown in Table 2.

Toward the end of the continuous image formation test, some image defects due to toner melt-adhesion were observed, although no streak (line) due to the charge nonuniformity was observed.

Comparative Examples 6 & 7

Examples 1 and 13 were repeated to produce electrophotographic photosensitive members and to evaluate, except that in addition to the DC voltage applied to the charge assembly an AC voltage with a $V_{P-P}$ of 1.8 kV and a frequency of 400 Hz was superimposed.

Results obtained are shown in Table 2.

TABLE 2

| | Lines caused by charge ununiformity | Change in VL | Transfer memory |
|---|---|---|---|
| Example: | | | |
| 1 | A | 0 | 10 |
| 2 | A | 0 | 15 |
| 3 | A | 0 | 15 |
| 4 | A | 10 | 20 |
| 5 | A | 5 | 10 |
| 6 | B | 5 | 15 |
| 7 | A | 0 | 5 |
| 8 | A | 0 | 10 |
| 9 | A | 5 | 15 |
| 10 | A | 5 | 10 |
| 11 | B | −5 | 20 |
| 12 | B | 10 | 25 |
| 13 | A | −10 | 0 |
| 14 | A | −10 | 5 |
| 15 | A | −5 | 10 |
| 16 | A | −10 | 5 |
| Comparative Example: | | | |
| 1 | C | 35 | 45 |
| 2 | C | 30 | 35 |
| 3 | C | 25 | 20 |
| 4 | C | 45 | 50 |
| 5 | C | 20 | 50 |
| 6 | A | 20 | 35 |
| 7 | A | 15 | 25 |

What is claimed is:

1. An electrophotographic unit comprising:

an electrophotographic photosensitive member comprising a conductive support and a photosensitive layer formed on the conductive support; said photosensitive layer comprising a charge generation layer and a charge transport layer, and said charge generation layer containing a polycarbonate resin having at least one of cyclohexylidene or isopropylidene as its central unit; and a charging member for electrostatically charging said electrophotographic photosensitive member by applying only a direct current voltage to said charging member, said charging member in contact with the surface of said electrophotographic photosensitive member.

2. The electrophotographic unit according to claim 1, wherein said electrophotographic photosensitive member has the charge generation layer on the conductive support and has the charge transporting layer on the charge generation layer.

3. The electrophotographic unit of claim 1, wherein said electrophotographic photosensitive member and said charging means being held into a process cartridge so that the cartridge can be freely mounted on or detached from the main body of an electrophotographic apparatus.

* * * * *

UNITED STATES PATENT AND TRADEMARK OFFICE

CERTIFICATE OF CORRECTION

PATENT NO. : 6,245,473 B1
DATED : June 12, 2001
INVENTOR(S) : Hideki Anayama et al.

It is certified that error appears in the above-identified patent and that said Letters Patent is hereby corrected as shown below:

Title page,
Item [62], Related U.S. Application Data, "Division" should read -- Continuation --.

Column 1,
Line 39, "to cause" should read -- cause --.

Column 2,
Line 24, "Superimpose" should read -- Superimposing --; and
Line 63, "resin;" should read -- resin; and --.

Column 10,
Line 27, "2.0 parts" should read -- R:-$CH_2CH_2OCOCH{=}CN_2$, ¶2.0 parts --.

Column 12,
Line 3, close up vertical space.

Signed and Sealed this

Sixteenth Day of April, 2002

*Attest:*

*Attesting Officer*

JAMES E. ROGAN
*Director of the United States Patent and Trademark Office*